United States Patent [19]

Mainiero

[11] 4,040,603

[45] Aug. 9, 1977

[54] BARBED METAL TAPE

[75] Inventor: Michael R. Mainiero, Monroe, Conn.

[73] Assignee: Man Barrier Corporation, Ansonia, Conn.

[21] Appl. No.: 679,155

[22] Filed: Apr. 22, 1976

[51] Int. Cl.[2] ..... B01F 25/00
[52] U.S. Cl. ..... 256/8
[58] Field of Search ..... 256/2–8; 140/58

[56] References Cited

U.S. PATENT DOCUMENTS

| | | | |
|---|---|---|---|
| 3,455,539 | 7/1969 | Loofbourrow | 256/8 |
| 3,463,455 | 8/1969 | Meckel | 256/8 |
| 3,763,529 | 10/1963 | Musgrave | 256/8 |

*Primary Examiner*—Werner H. Schroeder
*Assistant Examiner*—Doris L. Troutman
*Attorney, Agent, or Firm*—Prutzman, Hayes, Kalb & Chilton

[57] ABSTRACT

Coiled tape having successive linear segments each of equal length and uniformly angularly offset in the plane of the tape at identical bend angles relative to its trailing segment about a bend forming opening of predetermined size and shape.

14 Claims, 5 Drawing Figures

BARBED METAL TAPE

This invention generally relates to tape formed in a helical coil and particularly concerns a coil of barbed metal tape usable, e.g., as an anti-personnel barrier and the like.

A primary object of this invention is to provide a new and improved helical coil of metal tape with a continuous series of closed loops or turns having adjoining substantially planar, linear segments each angularly offset in a common angular direction from its trailing segment.

Another object of this invention is to provide such a coiled tape wherein its adjoining segments are each identical in length and are angularly displaced in the plane of the tape relative to its trailing segment at a precisely uniform bend angle.

A further object of this invention is to provide such a coiled tape featuring bend forming openings about which the tape is bent. Included in this object is the aim of providing a tape having such openings which are circular in shape, equally spaced apart along a longitudinal axis of the tape and are of identical diameter for use in serving to relieve stress, minimize any possibility of metal tearing in a bend zone surrounding each bend forming opening and which ensure uniform metal flow during edge bending of the tape.

Another object of this invention is the provison of a coiled tape of the type described wherein the bend forming openings additionally ensure controlled uniform stretching of metal along an outside tape edge and controlled uniform compression of metal along an inside tape edge adjacent each opening to provide uniform dimples of substantially identical construction in the compressed area of each bending zone of the metal.

Yet another object of this invention is to provide a coil of such tape wherein its bend forming openings and their adjacent dimples formed during edge bending of the tape further serves to ensure controlled stacking of adjoining turns of the col with their respective tape segments including their dimples being in confronting nested alignment with corresponding components of adjoining coil turns to define a helical coil having its turns stacked in regular, compact undeviating alignment while in collapsed condition for expedient storage and handling.

A further object of this invention is to provide a coiled tape of the above described type which has precision formed barbs equally spaced along longitudinally extending edges of the tape between the bend forming openings and which is suited to be paid-out into an extended condition for maximum effectiveness in field use, e.g., an an anti-personnel barrier.

Other objects will be in part obvious and in part pointed out more in detail hereinafter.

A better understanding of this invention will be obtained from the following detailed description and the accompanying drawings of an illustrative application of the invention.

Figure 1:
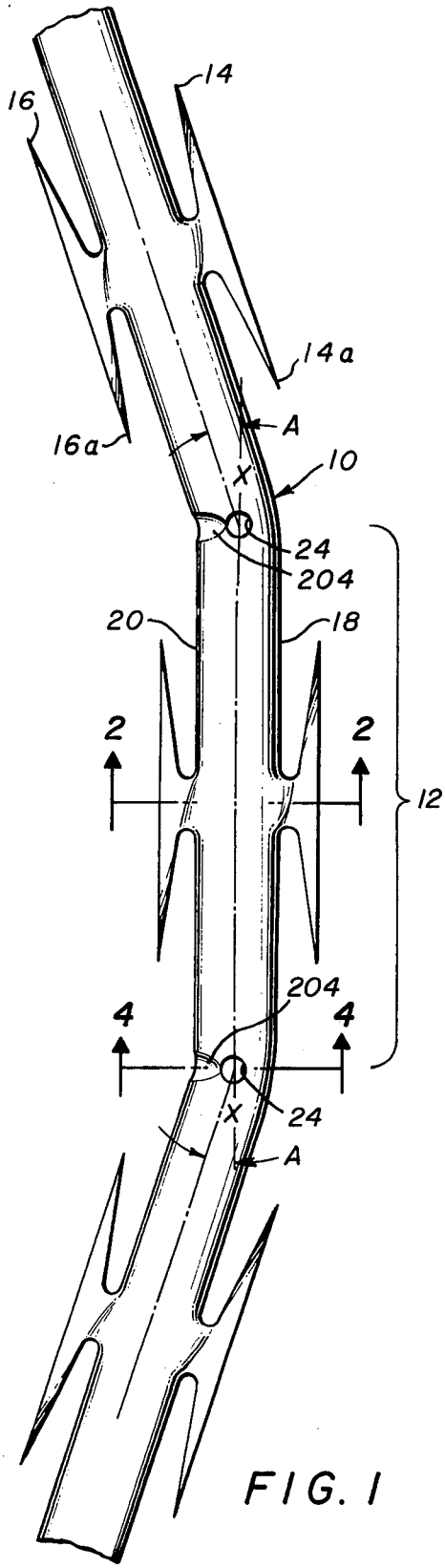
FIG. 1 is a plan view, partly broken away, showing a tape embodying this invention.

Referring to the drawings in detail, a barbed tape 10 is illustrated embodying this invention. Tape 10 is fabricated from linear, substantially planar, flat metal strip stock. Tape 10 has a continuous series of closed loops or turns defining a helica coil 11 with each closed turn having adjoining equiangularly offset linear segments of equal length such as at 12. Each turn of coil 11 is so formed as to be readily collapsed into stacked confronting nesting relation to its adjoining connected turns.

Tape 10 preferably is shown with barb clusters each providing four needle-sharp barbs with each four-barb cluster having two barb pairs **14, 14*a* and 16, 16*a* spaced opposed along opposite tape edges 18 and 20. For example, each barb pair may be, say 2 ⅜ inch long and equally spaced apart on 4-inch centers repeatedly along the length of tape 10** dimensioned, e.g., to be 0.025 inch thick and about 1.195 inch wide at the maximum width of the tape across barbs and fabricated for general purpose use, say, with 24 and 30 inch diameter turns. Such tape may be fabricated from flat strip stock of high carbon steel and is particularly suited to be formed from austenetic stainless steel 0.025 inch thick, e.g., hardened to Rockwell 30 N, 50–70.

Figure 3:
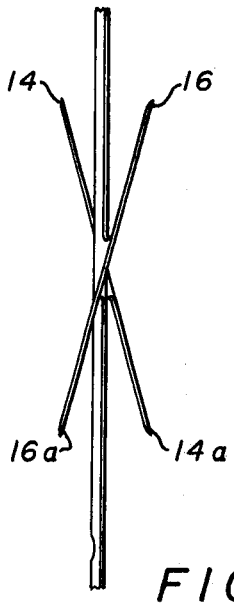
FIG. 3 is a partial side elevational view of the tape of FIG. 1.
Figure 4:
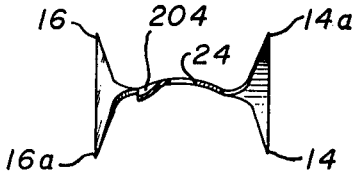
FIG. 4 is a section view taken along line 4—4 of FIG. 1.

The barbs of each pair **14, 14*a* and 16, 16*a* a respectively extend in opposite directions longitudinally of tape 10 with barb pair 14, 14*a* of each cluster reversely oriented relative to barb pair 16, 16*a* in inclined relation to the plane of tape 10 (FIG. 3**).

Figure 2:
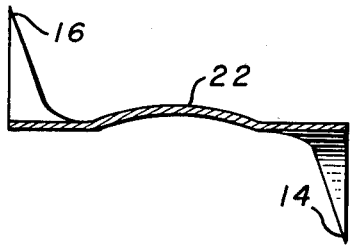
FIG. 2 is an enlarged section view taken along line 2—2 of FIG. 1.

Tape 10 is preferably also fabricated to provide a crown 22 in the plane of the tape 10 such that the finished tape in cross section (FIG. 2) curves to promote nesting of stacked turns when tape 10 is collapsed as well as to effectively resist deformation when installed in extended condition, for example, as an anti-personnel barrier. The plane of the crowned but substantially planar tape 10 will be understood to be that plane containing the longitudinally extending outside and inside tape edges 18 and 20.

Figure 5:
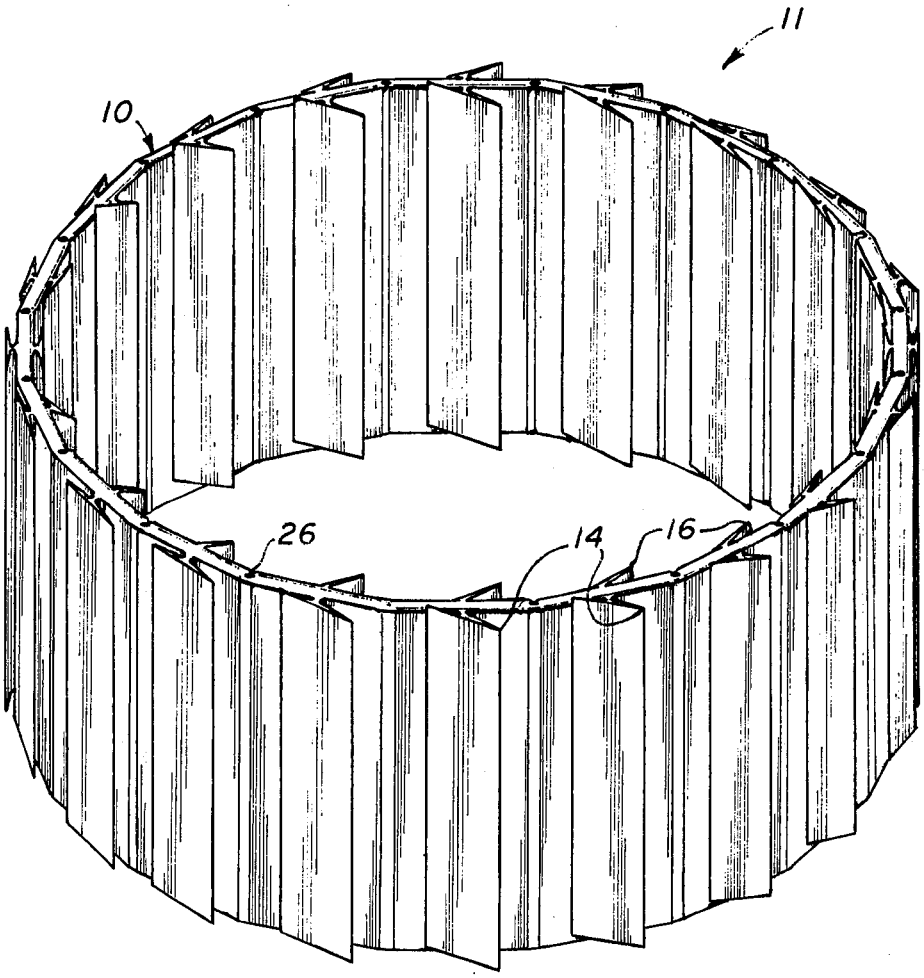
FIG. 5 is a reduced isometric view of the tape of FIG. 1 collapsed into a coil having a continuous series of closed turns.

The barb clusters are positioned in precise corresponding relation to one another along each turn of coil 11 such that linear segments 12 and their barb clusters of each closed turn of the coil may be positioned in face-to-face contact engagement with corresponding elements of their connected adjacent turns throughout their entire length when the turns are collapsed to nest in an axially aligned arrangement as best seen in FIG. 5.

To make barbed tape 10 which may be readily fabricated, even from the above described resilient spring steel, in an efficient high production, low cost operation to form a helical coil 11 of maximum effectiveness, the linear strip stock is first edge trimmed to form the barb clusters which are then reversely oriented into inclined relation to the plane of the tape as fully disclosed and described in United States patent application Ser. No. 679,326 entitled "Apparatus and Method For Forming Barbed Tape", filed Apr. 22, 1976 in the name of Michael R. Mainiero and assigned to the assignee of this invention. As disclosed in the referenced patent application, after the strip is formed with oriented barbs, the strip is then edge bent in the plane of tape 10 to form it into identical adjoining linear segments.

In the tape of this invention, openings or holes 24 are located precisely midway between successive barb clusters with the holes 24 being equally spaced apart and located on a central or major longitudinal axis X—X of tape 10. Such construction not only provides relief for deformation of tape 10 into a closed loop without tearing the metal incident to edge bending of tape 10 about each of its holes 24 along a transverse line intersecting hole 24, but additionally work hardens bend zones of tape 10 surrounding each bend forming opening or hole 24.

More specifically, to preclude unacceptable tearing of tape 10 in each bend zone as well as to ensure that the metal in each bend zone is identically formed, the bend forming holes 24 in each bend zone are formed in a circular shape of controlled equal diameter. Such construction has been found through experimentation to not only establish bend zones between adjoining tape segments of uniformly formed configuration but additionally provide consistent metal flow about holes 24 during such an edge bending operation to ensure a substantially identically constructed succession of angularly offset linear tape segments 12.

I. e., the metal in each bend zone between its bend forming hole 24 and outside tape edge 18 is stretched while the metal between each hole 24 and its adjacent inside tape edge 20 is compressed to form a dimple 204 in each bend zone. The controlled dimensioning and location of holes 24 and edge bending of each segment in the plane of tape 10 about its bend forming hole 24 through a precisely identical bend angle "A" serves to ensure the formation of dimples 204 of substantially identical configuration for uniformly controlled stacking of the turns of coil 11 in collapsed condition. Upon collapsing a completely formed coil, the dimples 204 in each bend zone thus are nested in contact engagement with corresponding dimples of aligned bend zones (FIG. 5) of the adjoining connected turns of coil 11.

In one specific embodiment of the tape 10 of this invention, the tape 10 is formed from the above described strip of austenetic stainless steel 0.025 inch thick, hardened to Rockwell 30 N 50–70, and dimensioned to be 0.600 ± 0.050 inch wide at its narrowest width along the trimmed edges of tape 10, specifically as dimensioned across the bend zone between adjoining tape segments 12. A bend forming hole 24 of 0.200 inch diameter is formed at each bend zone on the central longitudinal axis X—X of its tape segment 12. Accordingly, the ratio of the tape width at each bend zone to the diameter of its bend forming opening varies from about 2.75 to about 3.25 or is about 3 to 1 with the ratio of width of the tape to its thickness being established at about 24 to 1.

It has been found that a tape of the above described construction during the edge forming operation tempers itself and is full hardened in the bend zone. Upon being Rockwell tested, the metal in each bend zone has been found to be about twice the Rockwell hardness of the metal in the portions of the tape adjoining each bend zone.

It has also be found through experimentation that with a tape having the above described dimensional relationships, holes 24 of reduced diameter have been found to result in tearing of the tape at its bend zones and that holes of larger diameter than that described have weakened the bend zone sufficiently to result in tape coils of unacceptable quality.

While the dimensioning described for the specifically identified stainless steep strip stock is not as critical, e.g., for soft carbon steel, nonetheless, the provision of the bend forming opening between adjoining linear tape segments 12 does serve to control "dimpling" and, therefore, desired precision stacking of successive turns of the coil in a collapsed condition.

Accordingly, a coiled tape of the described construction not only has a succession of bend zones with bend forming holes therein of controlled uniform size, but the described tape construction establishes controlled metal flow at each bend zone to provide work hardened areas at the bend which become "full hardened" because of the severe work hardening effected by the edge bending process. The individual bend zones thus are each controlled during fabrication, and successive adjoining turns of the coil are accordingly controlled and dimensioned to ensure compact aligned stacking of each turn in face-to-face engagement with corresponding elements of confronting adjoining turns of the coil in a quality product particularly suited for reliable performance over an extended period of time under rugged conditions.

As will be apparent to persons skilled in the art, various modifications, adaptations and variations of the foregoing specific disclosure can be made without departing from the teachings of this invention.

I claim:

1. A coiled tape formed from substantially planar metal strip stock and comprising a plurality of closed turns of successive linear tape segments each angularly offset in the plane of the tape at a uniform bend angle to its trailing segment at a bend zone between the tape segments, the tape segments each being of substantially equal length and having a bend forming opening between the tape segments in the bend zone of the tape about which opening the tape is edge bent in the plane of the tape to form the angularly offset successive linear tape segments.

2. The tape of claim 1 wherein the metal in each bend zone between its bend forming opening and adjacent outside and inside tape edges are respectively stretched and compressed.

3. The tape of claim 1 wherein the bend forming openings in the tape bend zones are each formed on a central longitudinal axis of its linear tape segment.

4. The tape of claim 1 wherein the tape has a convex cross section extending between opposite tape edges to define a crowned upper surface longitudinally extending throughout the length of the tape.

5. The tape of claim 1 further including barb clusters equally spaced apart from one another midway between successive bend forming openings.

6. The tape of claim 5 wherein each barb cluster comprises two barb pairs on opposite edges of the tape with the barbs of each pair extending generally parallel to a central longitudinal axis of its linear tape segment, opposite barb pairs of each cluster on opposite tape edges being oriented to one another in reversely inclined relation to the plane of the tape.

7. A coiled tape formed from substantially planar metal strip stock and comprising a plurality of closed turns of successive linear tape segments each angularly offset in the plane of the tape at a uniform bend angle to its trailing segment at a bend zone between the tape segments, the tape segments each being of equal length and having a bend forming opening in its bend zone about which opening the tape is bent, the bend forming openings in the tape bend zones each being formed on a central longitudinal axis of its linear tape segment with the openings being of circular shape and equal diameter, the metal in each bend zone between its bend forming opening and adjacent outside and inside tape edges being respectively stretched and compressed, dimples of substantially identical configuration being formed in the metal between each opening and adjacent inside tape edge for uniformly controlled stacking of the turns of the coil in collapsed condition, the tape having a convex cross section extending between outside tape edges to define a crowned upper surface longitudinally extending throughout the length of the tape.

8. The tape of claim 7 wherein the tape is formed from a strip of stainless steel, wherein the ratio of the tape width at each bend zone to the diameter of its bend forming opening is about 3 to 1, and wherein the metal in each bend zone surrounding its bend forming opening is tempered and work hardened during edge bending to a full hard section having a Rockwell hardness greater than that of the metal adjoining each bend zone.

9. The tape of claim 8 wherein the ratio of width of the tape to its thickness is about 24 to 1.

10. The tape of claim 7 wherein the metal in each bend zone surrounding its bend forming opening has a Rockwell hardness of about two time greater than the Rockwell hardness of the metal adjoining each bend zone.

11. A coiled tape formed from substantially planar metal strip stock and comprising a plurality of closed turns of successive linear tape segments each angularly offset in the plane of the tape at a uniform bend angle to its trailing segment at a bend zone between the tape segments, the tape segments each being of equal length and having a bend forming opening in its bend zone about which opening the tape is bent, the bend forming openings in the tape bend zones each being of circular shape and of equal diameter and substantially identical dimples being formed in the metal in each bend zone between its opening and adjacent inside tape edge for uniformly controlled stacking of the turns of the coil in collapsed condition.

12. The tape of claim 11 wherein the ratio of the tape width at each bend zone to the diameter of its bend forming opening is about 3 to 1.

13. The tape of claim 11 wherein the ratio of the tape width at each bend zone to the diameter of its bend forming opening therein varies from about 2.75 to about 3.25.

14. The tape of claim 11 wherein the tape is formed of stainless steel, and wherein the metal in each bend zone surrounding its bend forming opening is tempered and work hardened during edge bending to a Rockwell hardness greater than that of the metal adjoining each bend zone.

* * * * *